US006196406B1

(12) United States Patent
Ennis

(10) Patent No.: US 6,196,406 B1
(45) Date of Patent: Mar. 6, 2001

(54) TWO-PART STORAGE CONTAINER

(75) Inventor: Declan Joseph Ennis, Dublin (IE)

(73) Assignee: High Meadow Patents Limited, Kildare (IE)

( * ) Notice: Subject to any disclaimer, the term of this patent is extended or adjusted under 35 U.S.C. 154(b) by 0 days.

(21) Appl. No.: 09/297,740

(22) PCT Filed: Nov. 7, 1997

(86) PCT No.: PCT/IE97/00075

§ 371 Date: Jun. 24, 1999

§ 102(e) Date: Jun. 24, 1999

(87) PCT Pub. No.: WO98/21122

PCT Pub. Date: May 22, 1998

(30) Foreign Application Priority Data

Nov. 8, 1996 (IL) ..... S960795

(51) Int. Cl.[7] ..... B65D 21/032

(52) U.S. Cl. ..... 220/23.83; 206/501; 220/735

(58) Field of Search ..... 220/23.83, 23.86, 220/4.21, 4.26, 4.27, 574, 574.1, 575, 735; 206/501, 541, 219, 442, 497

(56) References Cited

U.S. PATENT DOCUMENTS 2,979,193 * 4/1961 Fredette ..... 220/23.83
3,292,810 * 12/1966 Schechter ..... 220/23.83
3,381,876 * 5/1968 Biggins ..... 220/574
4,574,174 * 3/1986 McGonigle ..... 219/735
4,883,935 * 11/1989 Fairchild et al. ..... 219/734
5,664,671 * 9/1997 Nedblake, Jr. ..... 206/217
5,674,546 * 10/1997 Barnes et al. ..... 426/120

FOREIGN PATENT DOCUMENTS

2029648 * 12/1971 (DE) .
3314097A1 * 12/1983 (DE) .
2218962A * 11/1989 (GB) .

* cited by examiner

*Primary Examiner*—Stephen Castellano
(74) *Attorney, Agent, or Firm*—Barry R. Lipsitz

(57) ABSTRACT

A two-part container having upper and lower parts, each part being usable to house a product suitable for use with the product housed in the other part but which is stored separately. Each part has a top portion with a sealable aperture which is opened to access the product. The parts of the container are releasably secured together, the top portions overlying one another to protect the apertures from accidental puncturing. For example, the two-part container may be used for a soap powder or washing material stored in one part and a fabric softener or conditioner stored in the other part; a yogurt, fromage frais or soft ice-cream stored in one part and nuts, fruit or a biscuit crumb stored in the other part; and a cereal, cereal clusters or muesli stored in one part and milk in the other part.

12 Claims, 4 Drawing Sheets

TWO-PART STORAGE CONTAINER

Figure 1:
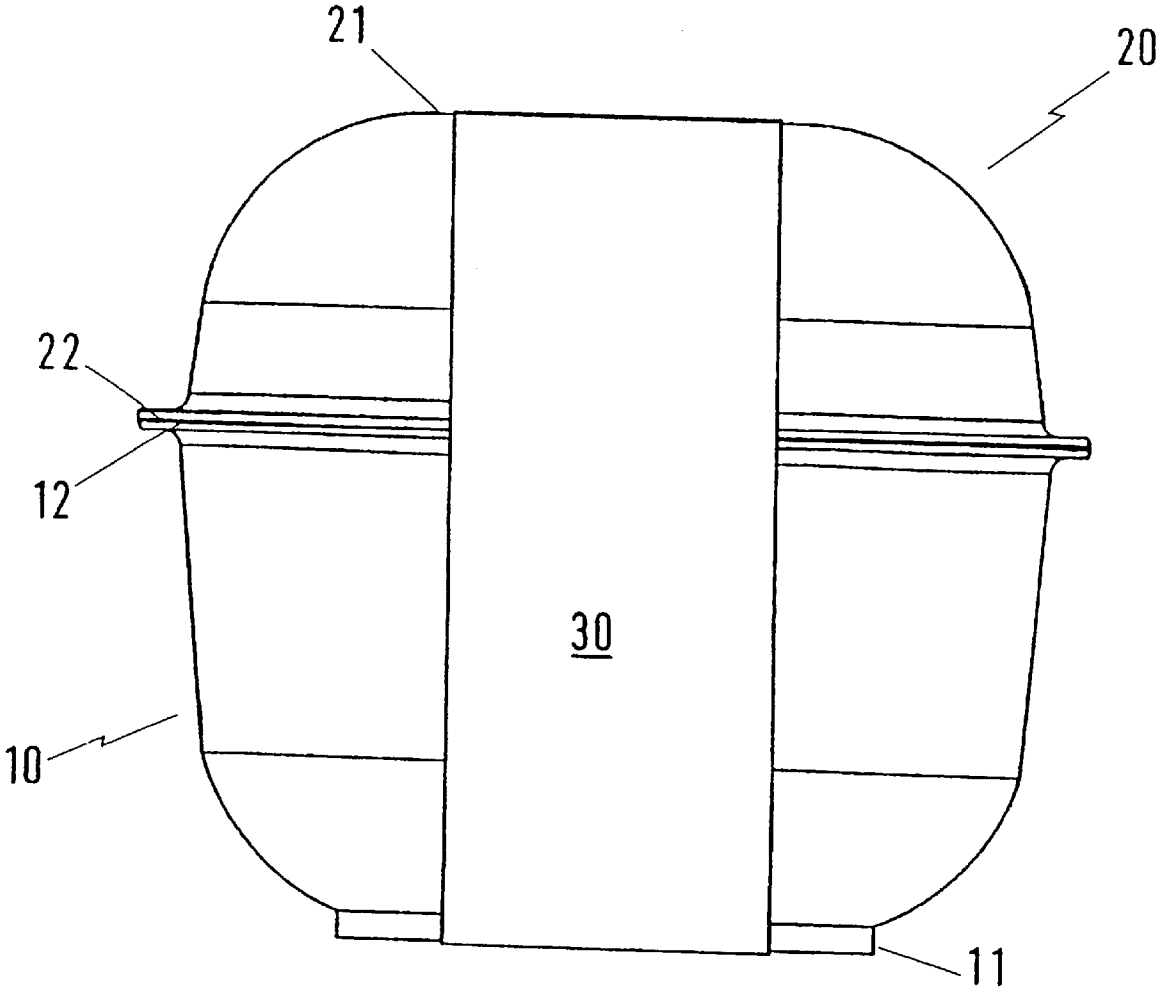

The present invention relates to a two-part storage container and more particularly to a two-part storage container which is used to store materials that are normally used together but which must be stored separately.

Many two-part containers are used to store materials which are used together but must be stored apart, particularly so where one of the materials to be stored would be destroyed, lose its texture, form an unsuitable solution, become sour or make one or both of the products stale. Two-part containers are generally substantially rectangular in shape and are of limited depth. The containers are covered by a foil which may be peeled back by the user. Normally one half or one corner of the rectangle is provided for one of the materials to be stored.

The above arrangements provide certain disadvantages. Firstly, the protective foil which covers the materials is easily punctured or forced inwardly, for example by pressure downwardly on the container tops due to improper stacking procedures. Any puncturing of the foil makes the article unsuitable for sale. Secondly, when the materials are to be used it is often desirable that one is poured into the other, this is not normally effected easily even where a scoreline is provided between one part of the container and the other. Additionally, due to the configuration of the rectangular container or the triangular part of a container, where a corner is cut from the rectangular container, there can be a high degree of wastage. Finally, the configuration or the foil wrapper of the known two-part containers do not allow for the storage of a spoon where the articles contained within the container are edible products. For convenience foods provided in such containers, a spoon must be supplied separately.

In one know solution described in WO 96/15950, a single use container having two parts is provided, each part hermetically sealing a product therein, the container including a wall separating the two parts. The wall includes an orifice which has a seal. The seal is broken to allow the product from one part to flow into the other part under gravity. A spoon is stored in one of the parts together with the product therein.

The above solution also presents certain disadvantages. Firstly, when the seal is broken the flow of material from one part to the other is controlled only by gravity. A user cannot decide to use a different ratio of one product to the other by controlling the flow. Secondly, this arrangement does not perform well with viscous or particulate products which would not flow freely through the orifice. In such a case, a relatively large percentage of one product would not be readily available for use by a consumer. Thirdly, the two parts of the container share a wall and are not separable. Therefore, a consumer has no access to the orifice to reseal the orifice. No consideration is given to the interruption of the use or consumption of the products or the subsequent re-use or continued consumption thereof. Finally, as the spoon is stored in one part together with the product, a user must open that part to extract the spoon before the products are mixed. As the product is presented as a convenience package, a consumer may not have opportunity to clean their hands before attempting to retrieve the spoon from within the product.

German Patent Publication No. 86 03 8904 (Meierei-Zentrale) discloses a combination breaker comprising two separate beaker halves united by means of a flap or loop-type connector. The beaker halves may be sealed shut with two separate cover foils.

German Patent Publication No. DE 33 14 097 (Ferrero) discloses a package comprising a pair of cup-shaped disposable containers each having a circumferential planar flange and a thin closure disc sealed to the flange. One of the containers is turned upside down and superimposed on the other container and the two are firmly held together by a pair of rings of cardboard or the like, secured by a staple and clamping the flanges therebetween. The containers may jointly reproduce a fruit, e.g. orange or lemon. The liquid composition may be frozen by the consumer in his domestic freezer to form ice-cream or sorbet.

German Patent Publication No. DE 20 29 648A (Hamm) discloses a package for snack articles such as peanuts, which can comprise two dishes, each having an opening which is closeable by a tear-off membrane, the dishes being securable on either side of a carrier.

It is an object of the present invention to seek to alleviate the above disadvantages and to provide an improved two-part container.

Accordingly, the present invention provides a two-part container, in which each part includes a sealable aperture to access the contents, the two parts of the container being releasably securable together, one part protecting the aperture of the other part from accidental opening, each part being usable to house contents separate from the contents of the other part, characterized in that one part comprises a substantially open container having a relatively large aperture sealable by a layer of foil and the other part comprises a substantially closed container having a relatively small aperture which is closable by a foil strip.

In one arrangement, the two parts are securable together to seal the contents of the open container when the two top portions overlie one another.

This arrangement protects a foil covered aperture from being accidentally punctured when the two parts of the containers are secured to and overlying one another for storage or transportation.

In one particular arrangement, the first one part is charged with a particulate or solid material and the other part is charged with a liquid, the liquid being pourable into the particulate or solid material for use.

In another arrangement, one part is charged with a liquid, gel or creamy material and the other part is charged with a particulate material, the particulate material being added to the liquid, gel or creamy material prior to use.

Conveniently, the sealable apertures are positioned facing one another so that the container parts are securable together.

Preferably, the container or part thereof is provided with a housing to retain an implement such as a fork, spoon, measuring scoop, applicator or the like.

Advantageously, one part is profiled for use as a bowl.

Preferably the aperture is profiled to ensure that flow of the contents therefrom is regulated so that spillage is avoided and so that only the required amount of the contents is used.

Ideally, the aperture is resealable so that any contents remaining in the container may be used subsequently.

Preferably, the two parts are secured together by a band wrapped around the container when the two apertures are positioned facing one another.

Advantageously, the band secures an implement to the container, the band hygienically encompassing the implement.

Conveniently, the band comprises a plastics material which is shrink-wrapped around the container.

Preferably, the or each part is nestable with a corresponding part so that, when empty, the or each part is nested with corresponding parts for efficient storage and/or transportation.

The two-part container may be used for any products which are used together but which must be stored separately. For example, a soap powder or washing material may be stored in a base part and a fabric softener or conditioner may be stored in the corresponding overlying part; a yogurt, fromage frais or soft ice-cream may be stored in the base part and nuts, fruit or a biscuit crumb may be stored in the overlying part; and a cereal, cereal clusters or muesli may be stored in the base part and milk may be stored in the overlying part.

Figure 2:
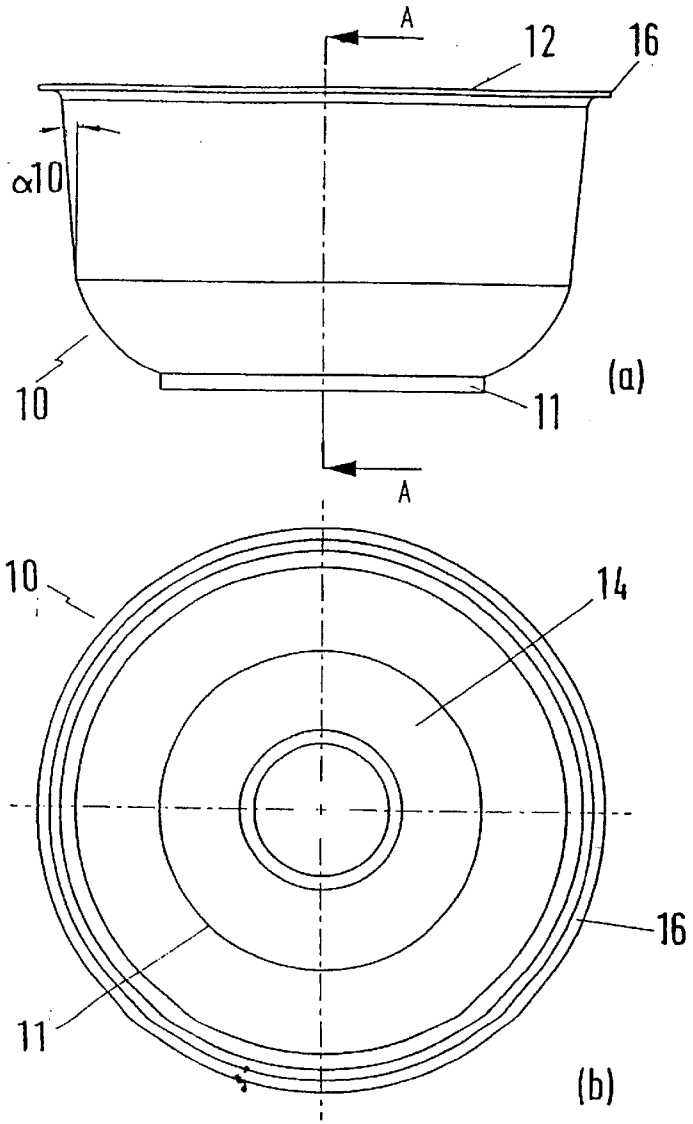
Figure 2:
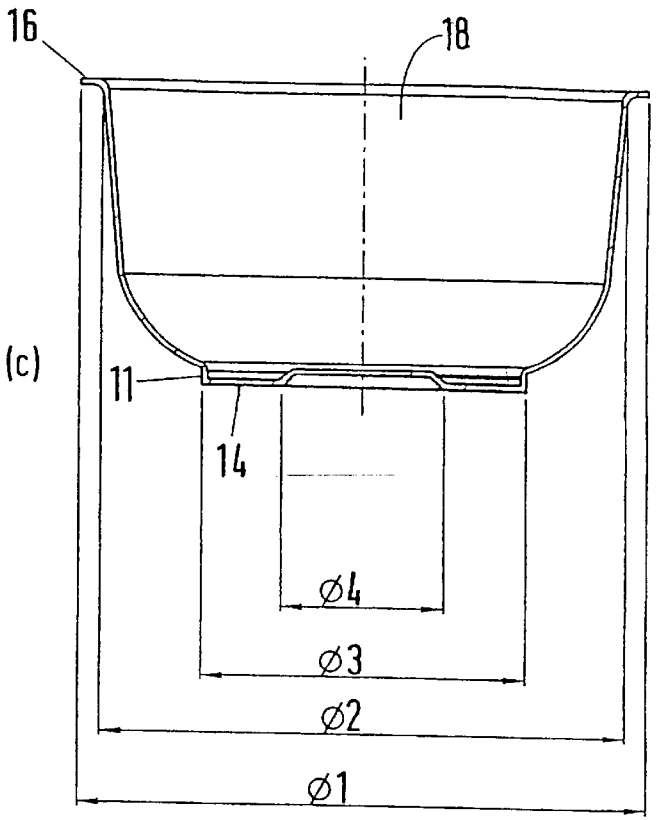
Figure 3:
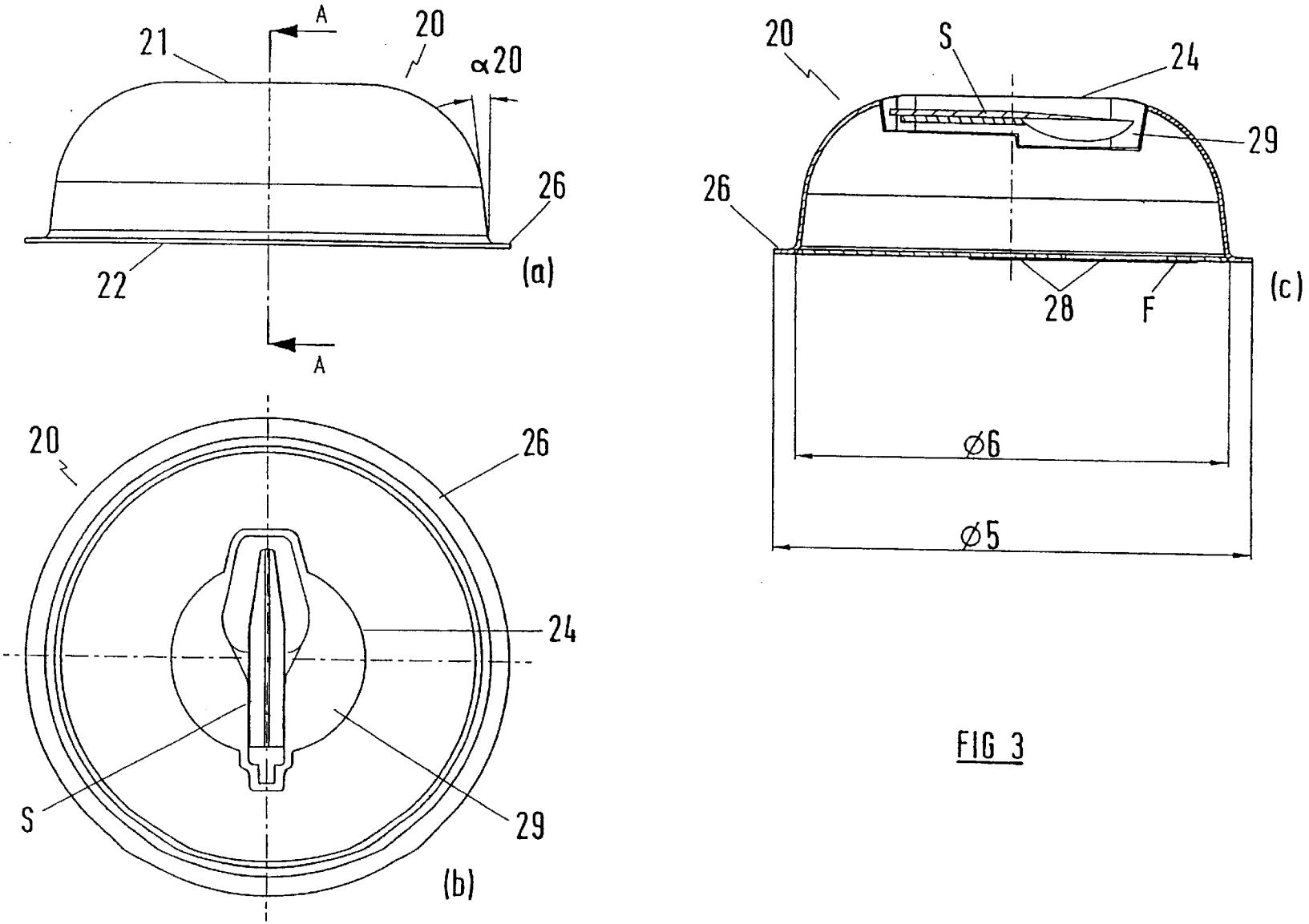
Figure 4:
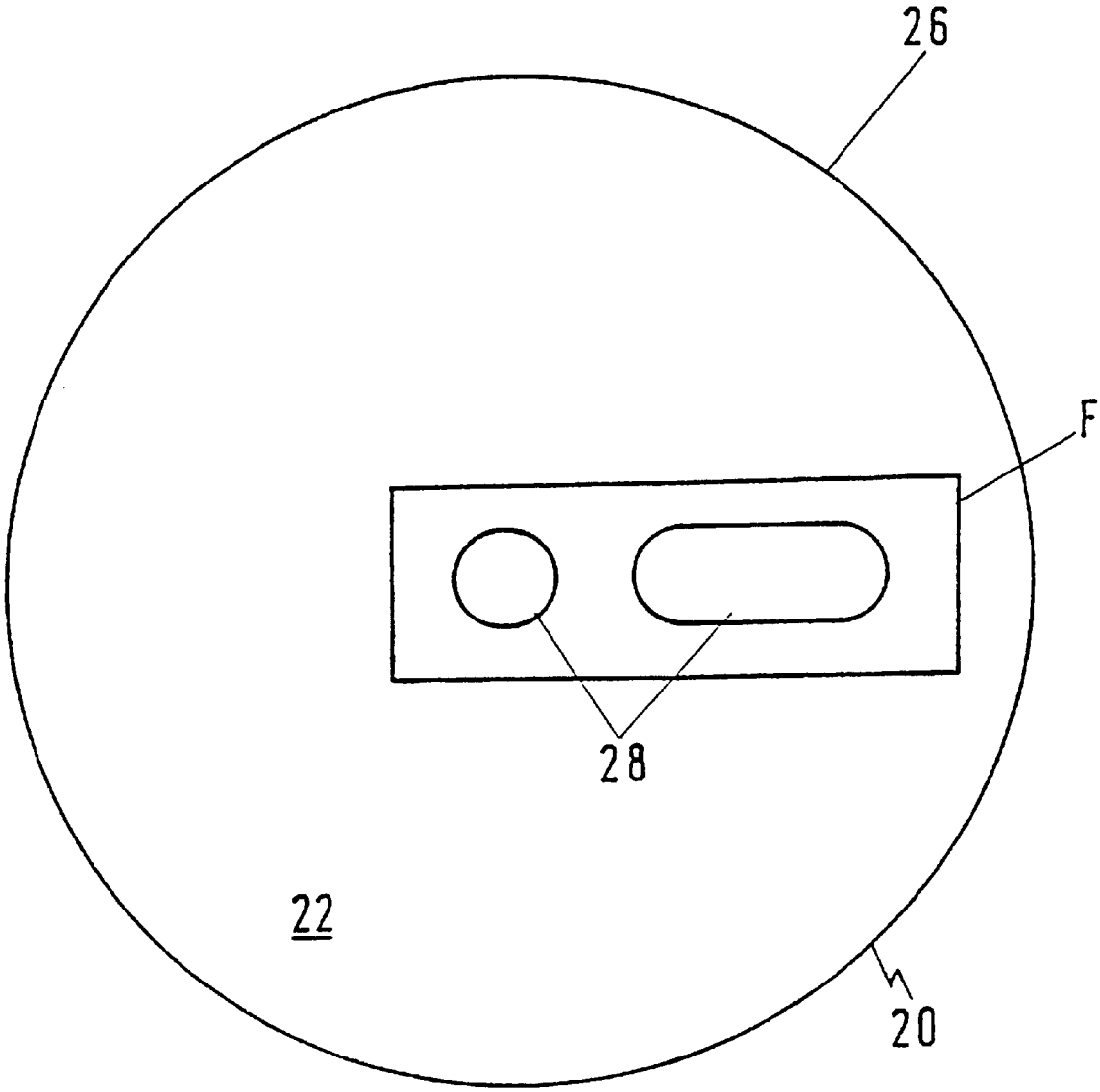

The present invention will now be described more particularly with reference to the accompanying drawings, which show by way of example only one embodiment of the two-part container according to the invention. In the drawings:

FIG. 1 is a side elevation of the two-port container in a storage or transport mode;

FIGS. 2*a* to 2*c* are a side elevation, top plan view and a sectional side elevation taken along the lines A—A of FIG. 2*a* of the lower part of the container, respectively;

FIGS. 3*a* to 3*c* are a side elevation, a top plan view and a sectional side elevation taken along the lines A—A of FIG. 3*a* of the upper part of the container, respectively; and FIG. 4 is a bottom plan view of the upper part of the container.

Referring to the drawings, the two-part container comprises a lower container 10 and a upper container 20, each container 10,20 having a base 11,21 and a top surface 12,22 which surfaces are placed adjacent one another by inverting the upper container 20 to lie over the lower container 10 to be held together by a shrink wrap band 30 for storage and transport.

The lower container 10 is shown in detail in FIGS. 2*a* to 2*c* and has a substantially bowl-shaped profile which includes a steadying rim 14 at its base 11. The bowl includes a flared rim 16 which defines an access aperture 18 over which a foil is attached to keep the contents fresh and to form the top surface 12.

The upper container 20 is of relatively smaller capacity than that of the first container 10. The upper container 20 has a substantially bowl-shaped profile including a steadying rim 24 at its base 21 and a flared rim 26 defining the top surface 22. Access apertures 28 which are sealed using a foil strip F, as shown in FIG. 4, are provided on the top surface 22. The apertures 28 are profiled to allow flow to be easily controlled. The base 21 of the upper container includes a recess 29 in which a scooping implement such as a spoon S is retained. For storage and transport, the spoon is protected from dust and dirt by the shrink wrap band 30.

The shrink wrap band 30 optionally surrounds the two-part container. In one arrangement (not shown) the lower container 10 is not provided with a sealing foil and the contents are kept fresh by the sealing action of the overlying upper container 20 and the enclosing shrink wrap 30.

All of the components of the two-part container, except the foils, are comprised of a thermoformable polystyrene or polyethylene material or optionally a thermoformable plastics material mix. The upper and lower containers are formed using standard moulding techniques.

Generally, the upper and lower containers 10,20 are manufactured at a site remote from the filling, sealing and packing site(s) of the products to be used therein. To facilitate the transportation and or storage of empty containers, the walls of the containers are angled $\alpha 10$, $\alpha 20$ so they may be nested with further identical containers (not shown).

The two-part container of the present invention is suitable for conveniently providing a breakfast cereal. The cereal is stored in the bowl shaped lower container 10 and is foil-sealed therein to retain freshness and crispness of the cereal and a treated milk product is stored in the upper container 20. To prolong the shelf life of the breakfast cereal product, the milk component is treated to reduce the butter-fat content and treated using various other processes to prolong the shelf life of the milk without altering its taste characteristics.

Alternative uses of the two-part container include; soap powder and fabric conditioner, yoghurt and nuts; ice-cream and fruit coulis; and cosmetic moisturiser and foundation make-up (with make-up applicator replacing the scooping implement). Where the container is adapted to be used in a microwave oven or can tolerate boiling water, one or both containers may hold a cookable foodstuff and the other may hold a sauce or gravy.

The spoon S illustrated in FIGS. 3*a* and 3*c* is formed with a folded shank so that the spoon S is held within the recess 29 of the upper container 20. The spoon 3 can include graduations for the measured mixing of the—contents of one container with the other or for measured dispensing of one or both of the products.

In a preferred arrangement the lower container 10 is 55 mm high and has an outer dimension $\phi 1$ of 105 mm including the rim 16 or an outer diameter $\phi 2$ of 97 mm excluding the rim 16. The base 11 includes the steadying rim 14 which has an outer diameter $\phi 3$ of 60 mm and an inner diameter $\phi 4$ of of 30 mm. The flared rim 16 at the top surface 12 of the container is 1 mm thick and the base 11 is 3 mm high. The nesting angle $\alpha 10$ of the lower container 10 is 5°.

The upper container 20 is 34 mm high and has an identical outer diameter $\phi 5$ including the rim 26 as that of the lower container 10 of 105 mm, the outer diameter $\phi 6$ excluding the rim 26 is 95 mm. The thickness of the rim 26 is 1 mm and the nesting angle $\alpha 20$ of this container is 7°.

It will of course be understood that the invention is not limited to the specific details described herein, which are given by way of example only, and that various modifications and alterations are possible within the scope of the invention as defined in the appended claims.

What is claimed is:

1. A two-part container, in which each part includes a sealable aperture to access the contents, the two parts of the container being releasably securable together, one part protecting the aperture of the other part from accidental opening, each part being usable to house contents separate from the contents of the other part, wherein:

one part comprises a substantially open container having a relatively large aperture sealable by a layer of foil;

the other part comprises a substantially closed container having a relatively small aperture which is closable by a foil strip; and the two parts are secured together by a band wrapped around the container when the two aperture are positioned facing one another.

2. A two-part container as claimed in claim 1, in which the band secures an implement to the container, the band hygienically encompassing the implement.

3. A two-part container as claimed in claim 2, wherein the implement is at least one of a fork, spoon, measuring scoop, or applicator.

4. A two-part container as claim in claim 1, in which the band comprises a plastic material.

5. A two-part container as claimed in claim 4 in which the plastic material is shrink-wrapped around the container.

6. A two-part container as claimed in claim 1, in which one part is profiled for use as a bowl.

7. A two-part container as claimed in claim 1, wherein an aperture of one part is profiled to ensure that flow of the contents therefrom is regulated so that spillage is avoided ad so that only the required amount of the contents is used.

8. A two-part container as claimed in claim 7 in which the sealable aperture of at least one part is resealable so that any contents remaining in the container may be used subsequently.

9. A two-part container as claimed in claim 1, in which one part is charged with a particulate or solid material and the other part is charged with a liquid, the liquid being pourable into the particulate or solid material for use.

10. A two-part container as claimed in claim 1, in which one part is charged with one of a liquid, gel or creamy material and the other part is charged with a particulate material, the particulate material being added to said one of the liquid, gel or creamy material prior to use.

11. A two-part container as claimed in claim 1, in which each part is nestable with a corresponding part so that, when empty, each part is nested with corresponding parts for efficient storage and/or transportation.

12. A two-part container as claimed in claim 1, in which at least a portion of the container is adapted to provide a housing to retain an implement.

* * * * *